United States Patent [19]

Perusco

[11] 4,095,724

[45] Jun. 20, 1978

[54] CONTAINER FOR HOLDING AND DISPENSING FLOWABLE PRODUCTS

[75] Inventor: Ivan Perusco, Riedheim, Germany

[73] Assignee: Precision Tools Ltd., Switzerland

[21] Appl. No.: 738,504

[22] Filed: Nov. 3, 1976

[30] Foreign Application Priority Data

Jun. 16, 1976 Germany ..... 2626990

[51] Int. Cl.[2] ..... B65D 35/28

[52] U.S. Cl. ..... 222/95

[58] Field of Search ..... 222/94, 95, 386.5

[56] References Cited

U.S. PATENT DOCUMENTS

| | | | |
|---|---|---|---|
| 3,389,833 | 6/1968 | Ramis | 222/95 |
| 3,905,517 | 9/1975 | Friedrich et al. | 222/95 |
| 3,979,025 | 9/1976 | Friedrich et al. | 222/95 |
| 4,013,195 | 3/1977 | Ferris | 222/95 |

*Primary Examiner*—Stanley H. Tollberg
*Assistant Examiner*—Francis J. Bartuska
*Attorney, Agent, or Firm*—Dowell & Dowell

[57] ABSTRACT

Apparatus for packaging and dispensing flowable material in which the material is contained within a soft inner container which is mounted within a rigid outer container and is dispensed by a pressurizing media located between the containers.

1 Claim, 15 Drawing Figures

CONTAINER FOR HOLDING AND DISPENSING FLOWABLE PRODUCTS

The invention relates to appliances for packaging of fluid and pasty products. The appliance consists primarily of a firm, pressure-strong outer container and a soft, flexible inner container mounted therein by a pressure seal. A discharge valve is located at the top of the appliance and the bottom of the firm outer container has a closeable opening for the introduction of a pressurizing media between the outer and inner containers. The pressurizing media has the function of ejecting the product from the inner container upon opening of the discharge valve.

Known are pressurized cans where a flexible inside container is located inside a firm outer container. These inside containers normally are ribbed like folded bellows and such ribs usually run around the container. When a discharge valve is opened, the inner container is compressed lengthwise, similar to the bellows of an accordion, by the pressurizing media between the containers to eject the matter contained in the inside container. When the individual ribs lie on top of each other, the compression is finished, while depending on the thickness of the wall more or less of a remainder stays inside the inner container and is not ejectable. Furthermore it can happen that the inside container is not compressed in this desired form but, instead, the inside container is deformed which prevents the ideal compression. It is also a disadvantage that on account of the complicated construction of the inside container the manufacturing costs are relatively high.

Also, there are receptacles known where the inside containers have reinforcing ribs lengthwise. With such containers the danger of a tieup is particularly great since the reinforcements collapse and a part of the product is retained in a kind of a bag.

Another variety of such a so-called double-chambered pressure package is a firm outside container with a flexible inside container which has bulges extending lengthwise thereof. Thus a controlled contraction of the container is made possible, however, this variety is only feasible if the outside circumference of the inside container is in proportion to the inside diameter of the firm outside container. It is sometimes necessary, however, to insert a relatively small inside container into a relatively large can so that a resulting decrease of pressure can be controlled better.

SUMMARY OF THE INVENTION

If one proceeds from this technical status, this invention is based on the technical problem to insure that an inside container collapses in a firm outside container, no matter what size, in such a manner that material in the inside container is substantially completely discharged. Also it is important that the container has a useful volume as large as possible, simple in assembly and inexpensive in manufacturing. In order to solve this problem, a known firm outside container is provided having a flexible inside container with a generally triangular cross-section and in which the three sides of the triangle have an arcuate configuration.

It is known that pressure on a surface offers the largest possibility of application. In the present case, pressure in the outer container will be applied first in the center of the arcuate surfaces and constrict the container from three sides toward the center regardless of whether the inner container touches the outer container or not. In every case, a triangular shaped container assures a controlled folding under pressure, which always ends in a three-pronged star. Containers are known which have a perforated tube in the center so that in case of a developing bag the product can rise in the center. In the present case the center of the star can never be completely compressed and therefore an open channel develops through which the product rises toward the discharge valve. A substantially complete discharge of the material is thus assured.

It would be advantageous if the inner container were manufactured with the edges of the walls thicker than the center or arcuate portion of the walls. Thus the edges would become still stiffer and the folding of the central portion of each wall would be assured in every case. The production of this inner container is possible at a favorable cost on account of its smooth simple design. The inner container preferably is constructed of a flexible thermoplastic material, a soft aluminum, or any flexible material.

In a first embodiment the inner container hangs in the upper rim of the outer container and is attached thereto by means of a discharge valve. In another embodiment the container is hung between the body and the upper cover of the can and is fastened thereto. An additional embodiment provides that the corners where the circular curve sections join, do not end in a point but in a cylindrical flat surface, a so-called adhesion surface. These small smooth adhesion or brake surfaces engage the wall of the outer container when the inner container is filled with the result that the inner container is not pulled lengthwise by the weight of the filling matter.

Description of the Preferred Embodiments

Figure 1:
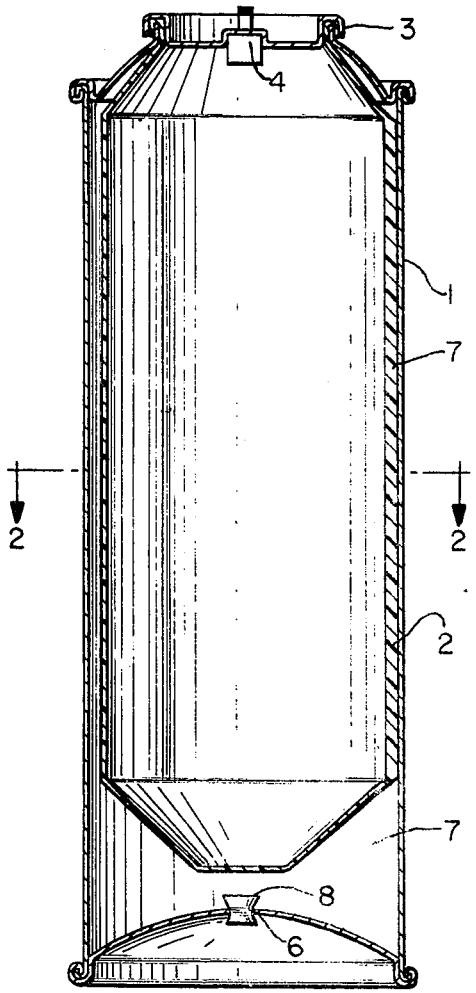
FIG. 1 is a vertical section illustrating one embodiment of the present invention.
Figure 3:
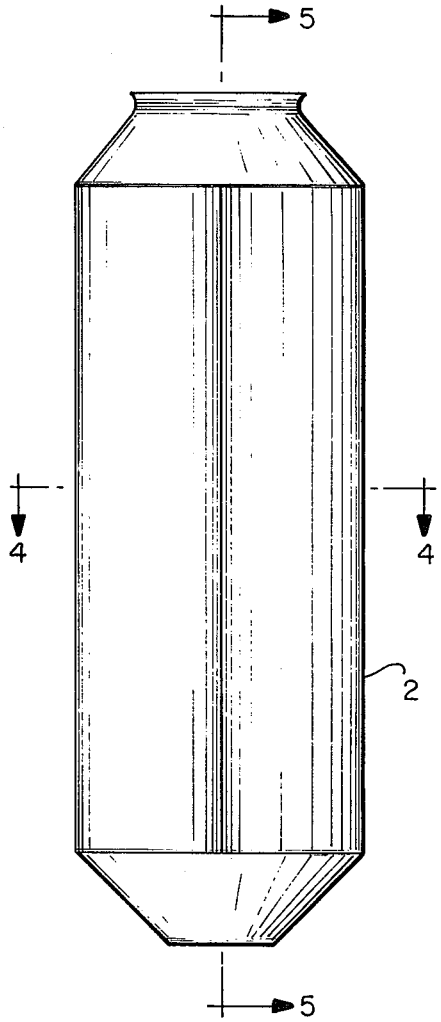
FIG. 3 is a side elevation of the flexible inner container used with the structure of FIG. 1.
Figure 2:
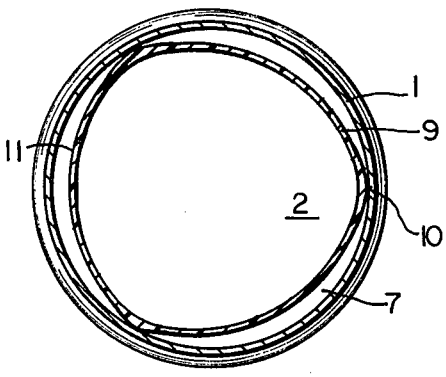
FIG. 2 is a section on the line 2—2 of FIG. 1.
Figure 4:
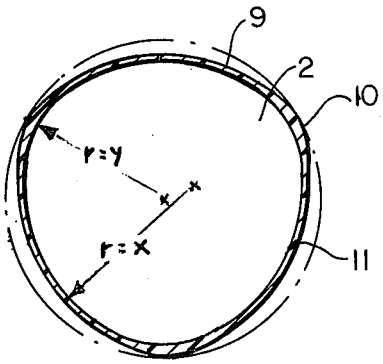
FIG. 4 is a section on the line 4—4 of FIG. 3.
Figure 5:
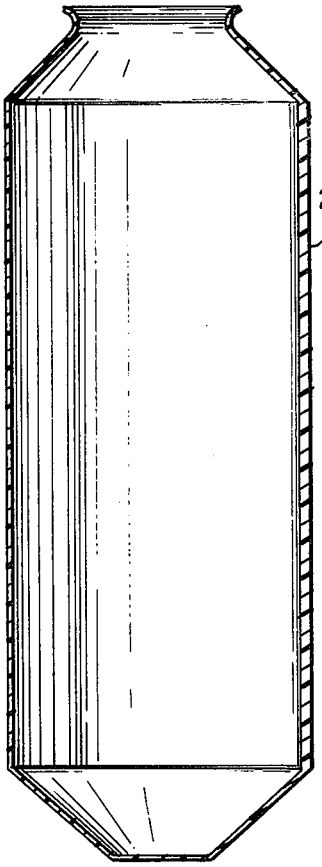
FIG. 5 is a section on the line 5—5 of FIG. 3.
Figure 6:
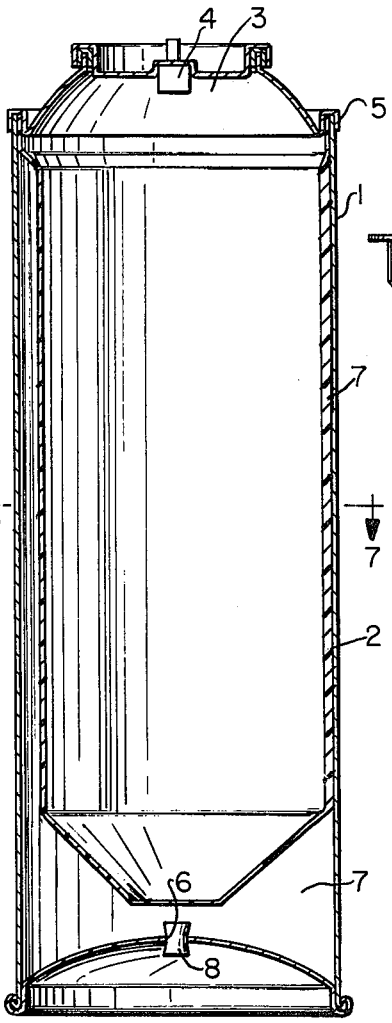
FIG. 6 is a vertical section of another embodiment of the invention.
Figure 8:
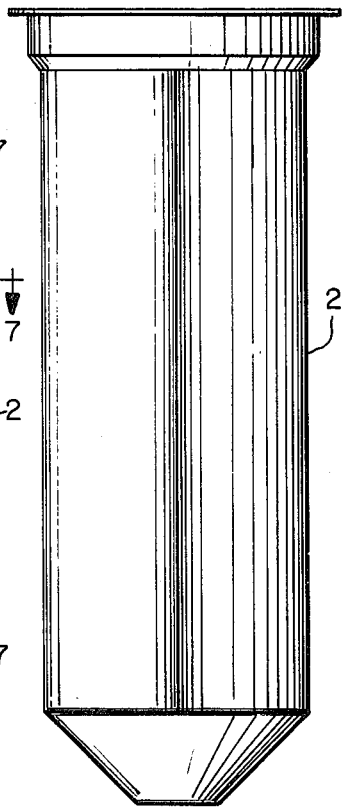
FIG. 8 is a side elevation of the flexible inner container used with the structure of FIG. 6.
Figure 7:
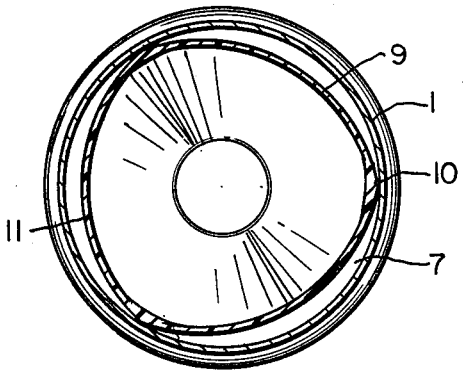
FIG. 7 is a section on the line 7—7 of FIG. 6.
Figure 9:
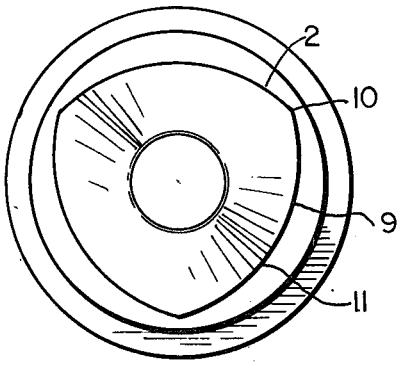
FIG. 9 is a bottom plan view thereof.

With particular reference to FIGS. 1 and 2, a firm substantially non-flexible outer container 1 is provided having a flexible inner container 2 with an upper opening 3 and which is attached to the outer container by a discharge valve 4.

With particular reference to FIGS. 6–9, the flexible inner container 2 is fastened in the rim 5 of the firm outer container 1.

In both embodiments, the bottom of the outer container 1 is provided with an opening 6 for introducing a pressure media into the area 7 between the inner and outer containers after which a plug or valve 8 is inserted into the opening 6. The appliance is filled through the opening 3 with the product to be dispensed through the discharge valve 4.

As can be seen in FIG. 2, the inner container 2 has about the form of a triangle. The legs or wall sections 9 of this triangle are fashioned as arcuate curves 9 which meet at a blunt angle 10. The radius X of the arcuate wall sections 9 must be larger than the radius Y of the circle over the corners 10 of the inner container 2. Also, as illustrated in the drawings, the radius of the wall sections 9 is larger than the radius of the inner wall of the outer container 1.

Figure 10:
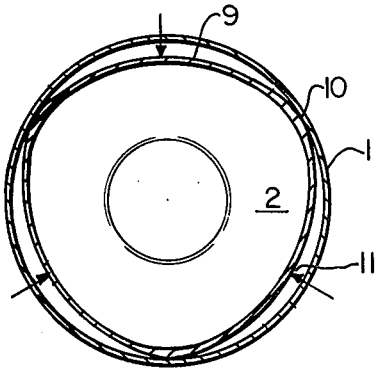
FIG. 10 is a longitudinal section illustrating the position of the inner and outer containers after the inner container has been filled.

When the discharge valve 4 is opened, the pressure prevailing in space 7 causes constriction of the inner container 2. The blunt angle 10 of the inner container 2 offers the pressure more resistance than the arcuate wall section 9 and, therefore, the expansive pressure of the media within the space 7 acts first on the arcuate wall section 9. Logically, this section 9 will first collapse lengthwise over the center 11 in direction of the arrow (FIG. 10).

Figure 11:
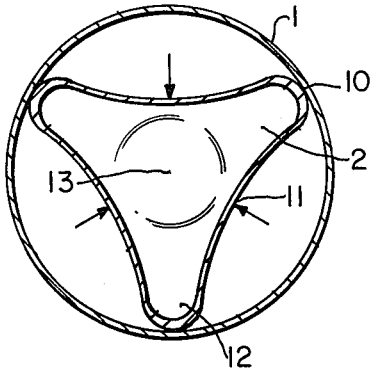
FIG. 11 is a section similar to FIG. 10 illustrating the inner container partially collapsed.
Figure 12:
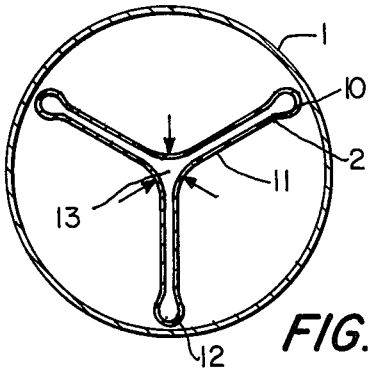
FIG. 12 is a section similar to FIG. 10 illustrating the inner container substantially completely collapsed.

During the further course of being emptied, the inner container, as illustrated in FIGS. 11 and 12, collapses in such a way that a star with three prongs 12 always develops. This manner of collapsing is completely independent of the diameter of the firm outer container 1. The number of prongs 12 is only dependent on the number of arcuate wall sections 9.

It is contemplated that the inner container 2 could have four or more corners, whereby four or more arcuate wall sections 9 would be built in.

On account of the form of a star, FIG. 12, it is not possible for the container 2 to become clogged. The center 13 of the star always serves as a hollow channel through which all products can be moved to the discharge valve 4 and thus to the outside. A substantially complete discharge of the material within the inner container 2 is therefore guaranteed.

Figure 14:
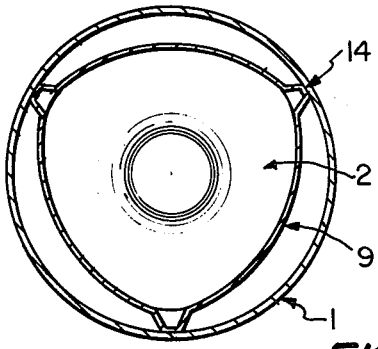
FIG. 14 is a section on the line 14—14 of FIG. 13 showing the inner container located within the outer container.
Figure 15:
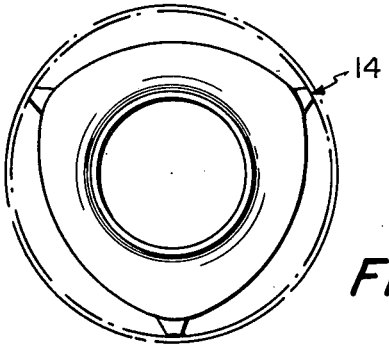
FIG. 15 is a top plan view thereof.
Figure 13:
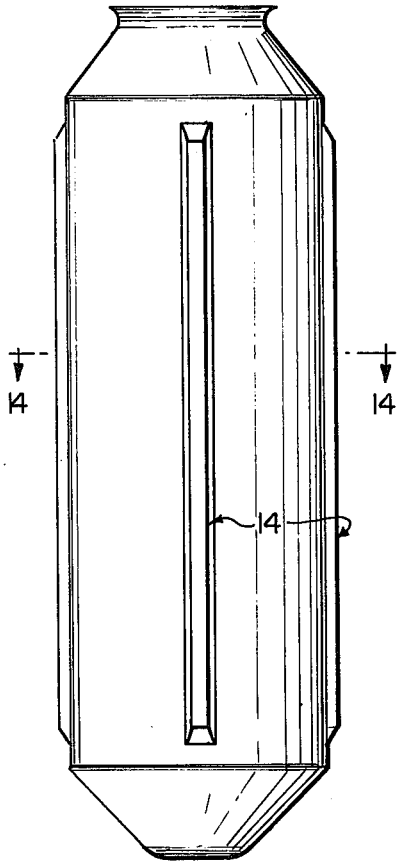
FIG. 13 is a side elevation of another embodiment of the inner container.

In the embodiment shown in FIGS. 13-15, the arcuate wall sections 9 of the inner container 2 do not meet at the corners 10, but in an adhesion or brake surface 14. These are small, smooth surfaces which are pressed against the wall of the outer container 1 when the inner container 2 expands as a result of being filled with the product. The adhesion or brake surfaces 14 prevent the inner container 2 from being pulled into the outer container 1 by the weight of the product.

I claim:

1. Apparatus for holding and dispensing flowable products comprising a substantially non-flexible outer container having a generally cylindrical inner wall, a flexible inner container for receiving a flowable product, said inner container having upper and lower end portions connected by an intermediate portion, said upper end portion being connected to said outer container, said lower end portion having a downwardly extending generally frusto-conical configuration, said intermediate portion being of non-circular cross-section and including at least three blunt angles connected by arcuate wall sections, each of said arcuate sections having a radius which is larger than the radius of the inner cylindrical wall of said outer container, the exterior surfaces of said blunt angles frictionally engaging the inner wall of said outer container, the inner surface of each of said blunt angles having a radius which is less than the radius of each of the arcuate wall sections, said blunt angles being substantially thicker than said arcuate wall sections, selectively operated discharge valve means mounted on said outer container and communicating with the contents of said inner container, and a pressure media located in said outer container and exteriorly of said inner container so that when said discharge valve means is operated said pressure media causes said arcuate wall sections to collapse inwardly and discharge material through said valve means while said blunt angles remain substantially in engagement with said inner walls of said outer container.

* * * * *